US006863501B2

(12) United States Patent
Galassi

(10) Patent No.: US 6,863,501 B2
(45) Date of Patent: Mar. 8, 2005

(54) DOMESTIC OR INDUSTRIAL HOOD HAVING A RAPID ATTACHMENT DEVICE FOR A CENTRIFUGAL FAN

(75) Inventor: Alvaro Galassi, Fossato Di Vico (IT)

(73) Assignee: Faber S.p.A., Fabriano-Ancona (IT)

( * ) Notice: Subject to any disclaimer, the term of this patent is extended or adjusted under 35 U.S.C. 154(b) by 0 days.

(21) Appl. No.: 10/370,444

(22) Filed: Feb. 20, 2003

(65) Prior Publication Data

US 2003/0161723 A1 Aug. 28, 2003

(30) Foreign Application Priority Data

Feb. 26, 2002 (IT) ..... MI20020096 U

(51) Int. Cl.[7] ..... F01D 25/00
(52) U.S. Cl. ..... 416/244 R; 415/206; 454/67
(58) Field of Search ..... 416/244 R; 415/206, 415/213.1, 214.1; 454/67, 49, 345

(56) References Cited

U.S. PATENT DOCUMENTS 5,515,840 A * 5/1996 Jang ..... 126/299 R
5,720,274 A 2/1998 Brunner et al.
5,775,319 A * 7/1998 Pettinari ..... 126/299 R
5,788,565 A * 8/1998 Chang ..... 454/67
5,983,888 A * 11/1999 Anselmino et al. ..... 126/299 R

FOREIGN PATENT DOCUMENTS

| | | |
|---|---|---|
| CH | 684 763 | 12/1994 |
| EP | 0 833 112 | 4/1998 |

OTHER PUBLICATIONS

EPO Search Report.
Patent Abstract of Japan vol. 007, No. 153 (M–226), Jul. 5, 1983.

* cited by examiner

*Primary Examiner*—F. Daniel Lopez
*Assistant Examiner*—James M. McAleenan
(74) *Attorney, Agent, or Firm*—Hedman & Costigan, P.C.

(57) ABSTRACT

A domestic or industrial hood having a rapid attachment device for a centrifugal fan wherein an opening (13) is foreseen in the structure (12) of the hood being externally connectable to a discharge hose and adapted to receive one end (17) of a centrifugal fan (16), and wherein the opening (13) in said hood is equipped with a flange (14) for centring and housing the upper exit end (17) of the centrifugal fan (16) and also including at least one easily removable centring and attachment element (19) from a lower portion (20) of the fan (16) on the hood structure.

8 Claims, 5 Drawing Sheets

DOMESTIC OR INDUSTRIAL HOOD HAVING A RAPID ATTACHMENT DEVICE FOR A CENTRIFUGAL FAN

The present invention relates to a domestic or industrial hood having a rapid attachment device for a centrifugal fan.

On domestic and/or industrial hoods, the centrifugal fan conducts an air flow of a certain quantity from the inside of closed environments towards the outside. This is performed through suitable evacuation ducts, that sucks the air from environments saturated with greasy vapours, variously sized oily particles microdispersed in the air, dust, humidity and various organic particles composing highly polluting and fouling mixtures directing them towards surfaces to create an impact, that then slide to deposit subsequent layers of solid particles through speed loss or adhesion.

Therefore it is very important to clean the conductive ducts regularly and frequently to maintain the original performance levels and to eliminate fire risk determined by the increased particle deposit, which is very often composed of easily inflammable greasy particles.

Therefore current domestic and industrial hoods require frequent and regular cleaning operations. In particular, this operation is especially important in Scandinavian countries, where more for systematic use rather than for compliance with regulations, regular cleaning of hood evacuation pipe is performed for example once or twice every year.

On known current domestic or industrial hoods, the structure of the actual hood has an opening on the upper part to connect fume evacuation pipe. The fan, mounted with its relative control and power supply cable is housed in the hood structure so that the upper outlet opening is aligned with the evacuation pipe. This creates certain problems in that the evacuation pipe must be attached to the fan outlet opening using screws or clamp strips.

Once the adaptation and connection operation has been completed the fan must be fixed using a certain number of screws, at least four, to attach the fan to the rear wall of the hood structure.

Therefore, the fan must be screwed to the upper part of the cover, and also screwed to the rear part. Of course such screws are not easily accessible since the hood is usually mounted in a restricted narrow space.

It is easily understandable how operations such as those described above cannot be performed by the user because of their complexity, requiring an intervention by a man skilled in the art, who has suitable tools, which means time and cost increase.

Attempts have been made to simplify this operation by separating the power supply and control cables from the fan, connecting them only after the fan has been screwed to the rear hood wall.

This second solution has certainly improved the installation conditions for the fan work position, but it does not eliminate the need for a man skilled in the art for the alignment of the evacuation pipe with the upper fan opening, as well as stable installation thereof with relative clamp strip.

Accordingly, none of the known fan assembly and/or disassembly systems on domestic or industrial hoods provides the required criteria of simplicity, repeatability, and ease for fan assembly and disassembly. This results in slow and difficult operations, and in high cost for the user because of the necessity for intervention by a man skilled in the art.

In fact, one of the most difficult problems to solve concerns the screws that are hard to access in restricted spaces and narrow cavities, where even for men skilled in the art with appropriate tools, intervention times are long and operating is difficult. Moreover, the discharge or evacuation duct positioned on the hood opening does not always allow a quick alignment with the upper opening on the fan since the hose must be connected from the opposite side compared to the upper opening on the domestic or industrial hood structure.

Accordingly, none of these systems provides the required criteria of simplicity, repeatability, and ease of disassembly and assembly of the parts constituting the well-operating suction hood. And this in order to guarantee the frequent and regular cleaning operations both by the common user and by the maintenance technician, which is typical in the above mentioned Scandinavian countries. This results in slow and difficult interventions, with high costs for the user.

The general object of the present invention is to provide an optimal solution to the aforementioned technical problems.

In particular, one of the objects of the present invention is to provide easy, rapid, repeatable and safe assembly and disassembly of the fan, preventing wear of the centrifugal fan on the hood structure, and eliminating the need for difficult and uncomfortable screwing operations.

A further object is to provide this assembly and disassembly operation that can be performed directly by the end user, whether man or woman, easily and without excessive difficulties. Moreover, it should be remembered this user usually does not have specific instruments and does not possess the technical background necessary to avoid mistakes during reassembly of exhaust hoods in a safe manner.

These objects according to the present invention are achieved with the construction of a domestic or industrial hood equipped with a rapid fixing device for the centrifugal fan as described in the appended claim 1.

Further important and particular characteristics of the present invention are described in the dependant claims.

The characteristics and advantages of a domestic or industrial hood with a rapid fixing device for the centrifugal fan according to the present invention will be better appreciated and made clearer in the following description, provided as a non limiting example, of an embodiment with reference to the appended figures in which.

Figure 1:
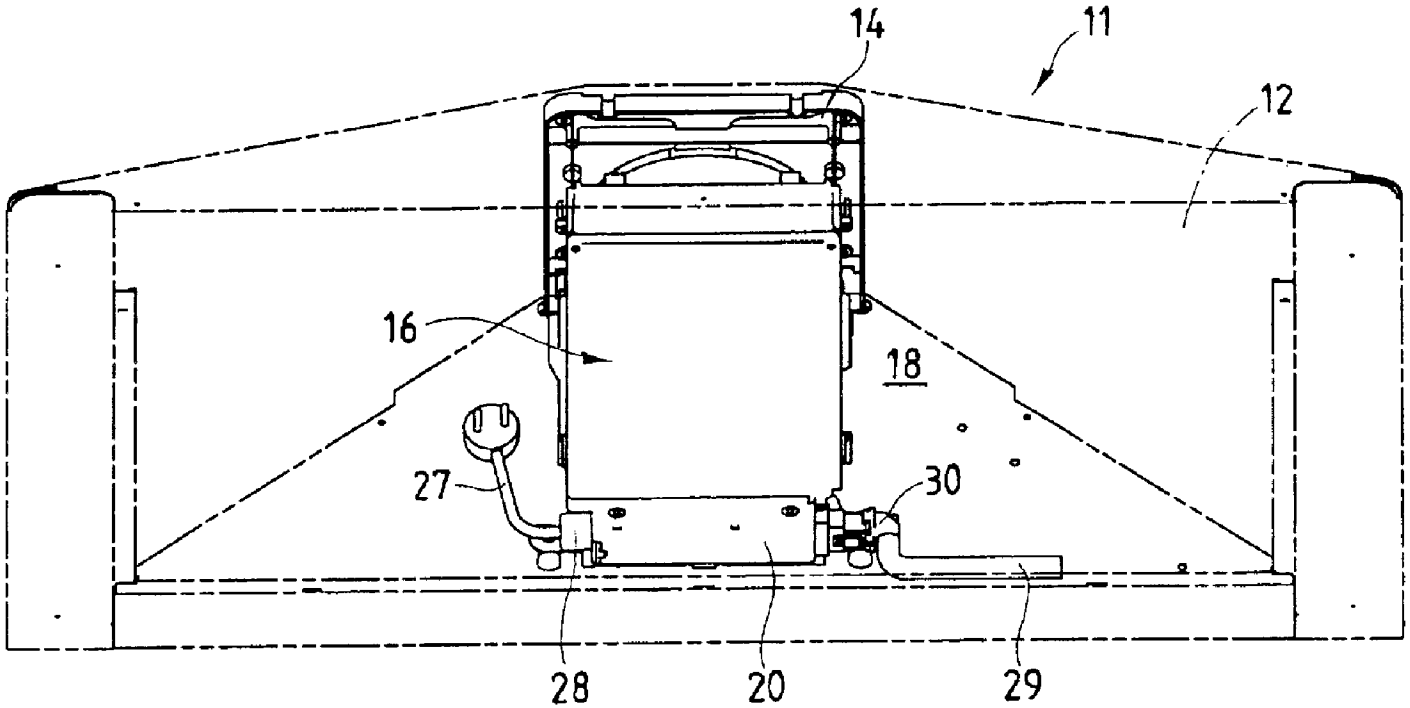
FIG. 1 is a front perspective view of the lower part of a domestic or industrial hood with a rapid fixing device for a centrifugal fan according to the present invention, wherein the structure of the hood is shown with dotted lines.

With general reference to FIG. 1, the domestic or industrial hood is illustrated schematically equipped with a rapid fixing device for a centrifugal fan according to the invention, wherein the hood is indicated with the reference numeral 11.

The domestic or industrial hood presents a fume or vapour collection structure 12, which is wider at the bottom, and tapered towards the top towards an upper opening 13. The structure of the hood 12 carries at the upper opening 13 a centring and housing flange 14 of a upper outlet end 15 of a centrifugal fan 16.

The flange 14 has an upper tubular extension 17 where a lower terminal end (not shown) of an evacuation or discharge pipe (not shown) directed towards the exterior of the environment where said hood is installed, is placed and connected. Such lower terminal end of the evacuation or discharge pipe is fixed in a standard manner using strips or the like, and its removal is not necessary, the pipe being accessible for cleaning interventions directly from the inside of the hood according to the invention. Flange 14 is connected and attached to structure 12 of the hood 11 directly, prior to its installation on a wall or the like.

A rear wall 18 of the hood structure 12 has also easily removable centring and fixing elements, indicated with the reference numeral 19, for a lower portion 20 of the fan 16 of the hood structure 12.

In fact the rear wall 18 carries two centring pins 21 and two right-angled levers 22 rotating on the hood structure 12 around pivot pins 23 by means of an extension knob 24. On the other end of the right angle lever 22 a concave portion 32 is envisaged designed to engage with the corresponding centring pin 21.

On the other hand, on the lower portion 20 of the fan 16, at opposite ends a slot 25 is envisaged in a portion of edge plate 26.

The supply cables 27 with rapid insertion connections 28 and the control cable 29 with rapid insertion connection 30 are envisaged for attachment on the rear wall 18 of the hood structure 12.

From the aforementioned descriptions related to the present invention, the assembly and disassembly function of a domestic or industrial hood equipped with a rapid fixing device for a centrifugal fan according to the present invention is immediately apparent.

Figure 2:
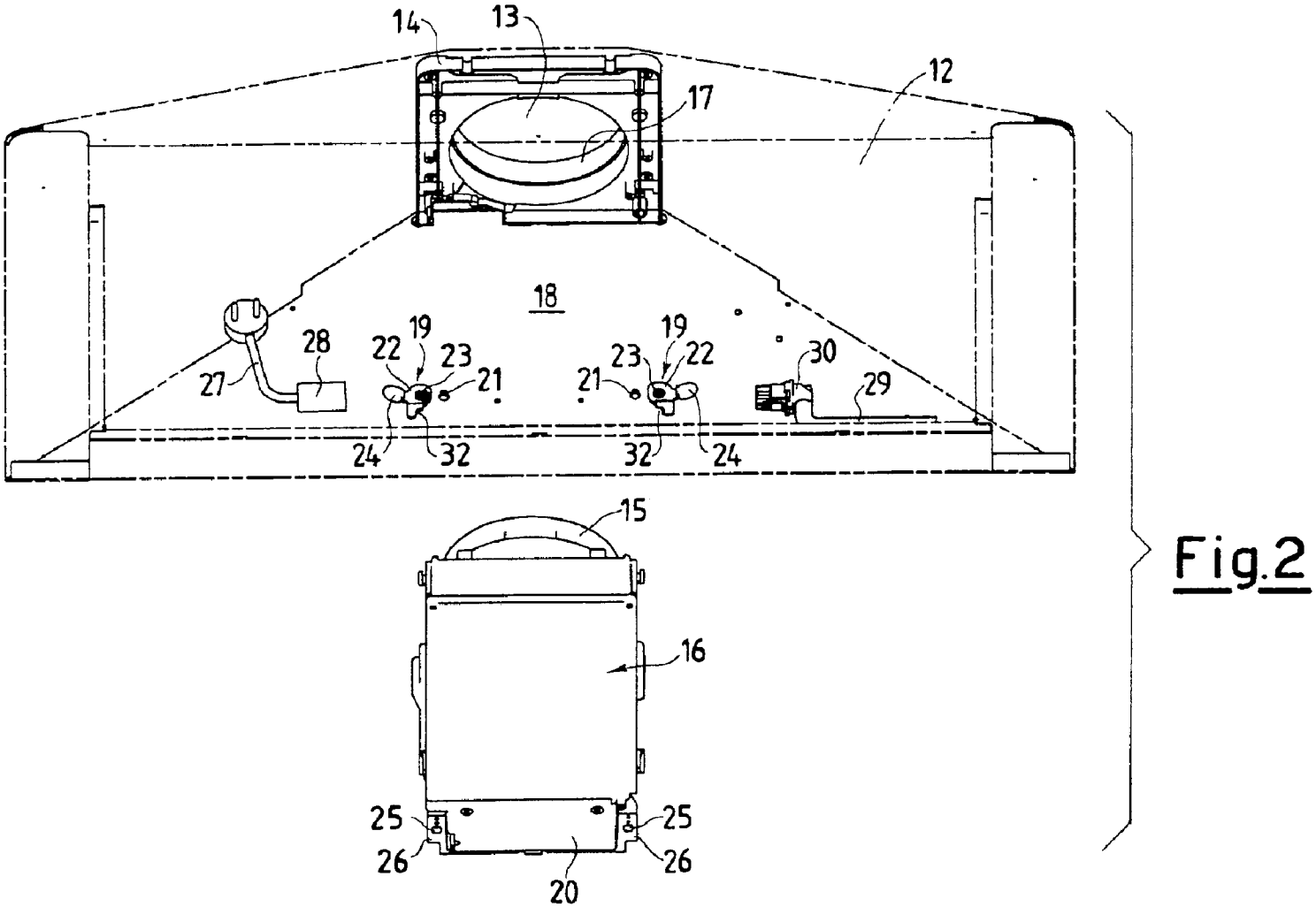
FIG. 2 is a perspective view similar to that shown in FIG. 1 wherein the various parts have been exploded prior to the assembly of the fan on the hood.
Figure 4:
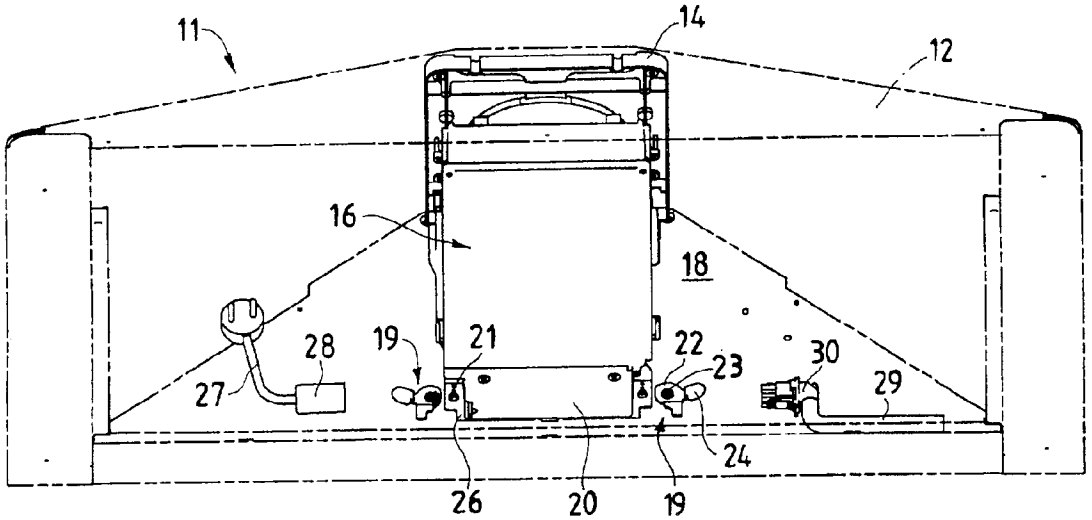
FIG. 4 is a perspective view similar to that shown in FIG. 2 in a subsequent assembly stage wherein the fan is installed in the hood structure.
Figure 5:
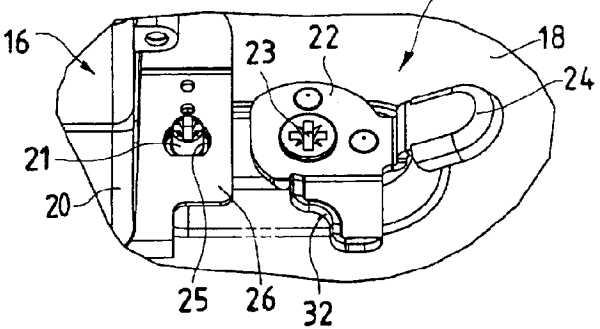
FIG. 5 is an enlarged perspective view of the same fixing element in FIG. 3 prior to its engaging on the fan.
Figure 3:
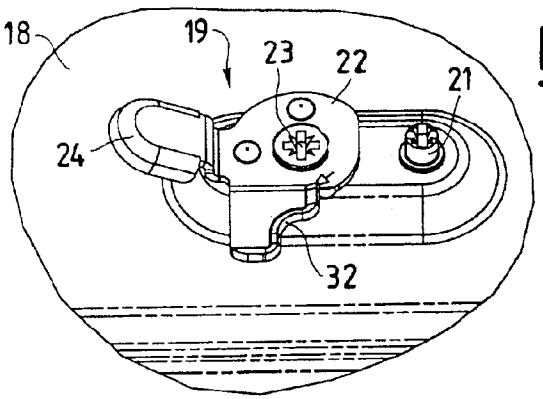
FIG. 3 is an enlarged perspective view of a fixing element envisaged as attached to the hood structure.
Figure 6:
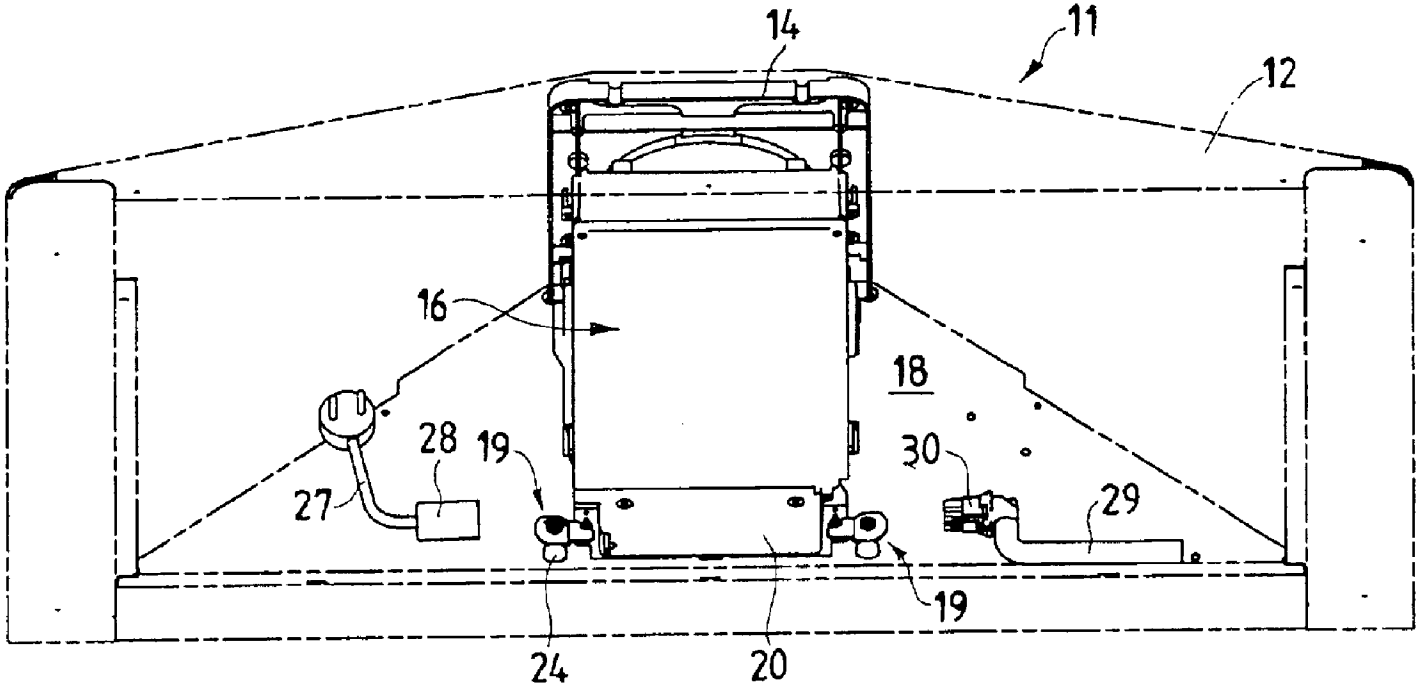
FIG. 6 is a perspective view similar to that in FIG. 4 in a subsequent assembly stage wherein the engaging elements have been arranged to block the fan in position.

We will consider for example, the case wherein the fan 16 is to be installed on the rear wall 18 of the hood structure 12, beginning with the situation shown in FIG. 2.

In this situation, it should be remembered that the hood structure 12 foresees a centring flange 14 on the upper opening 13, and that the upper tubular extension 17 of the flange 14 is connected to a lower terminal end of an evacuation or discharge pipe directed towards the outside of the environment involved. Therefore there is no need for any other type of fixing means for the evacuation pipe.

The fan 16 is raised, its upper outlet end 15 being inserted inside flange 14.

Thus the two slots 25 in the portion of the edge plate 26 on fan 16 are hooked onto two centering pins 21 attached to the rear wall 18 so that the r4ear surface of fan 16 and the rear wall 18 of the hood structure 12 abut with each other.

Once this simple operation has been performed the two right-angled levers 22 are rotated one after the other so that they overlap the portions of the edge plates 26 on fan 16, thus blocking them.

Figure 8:
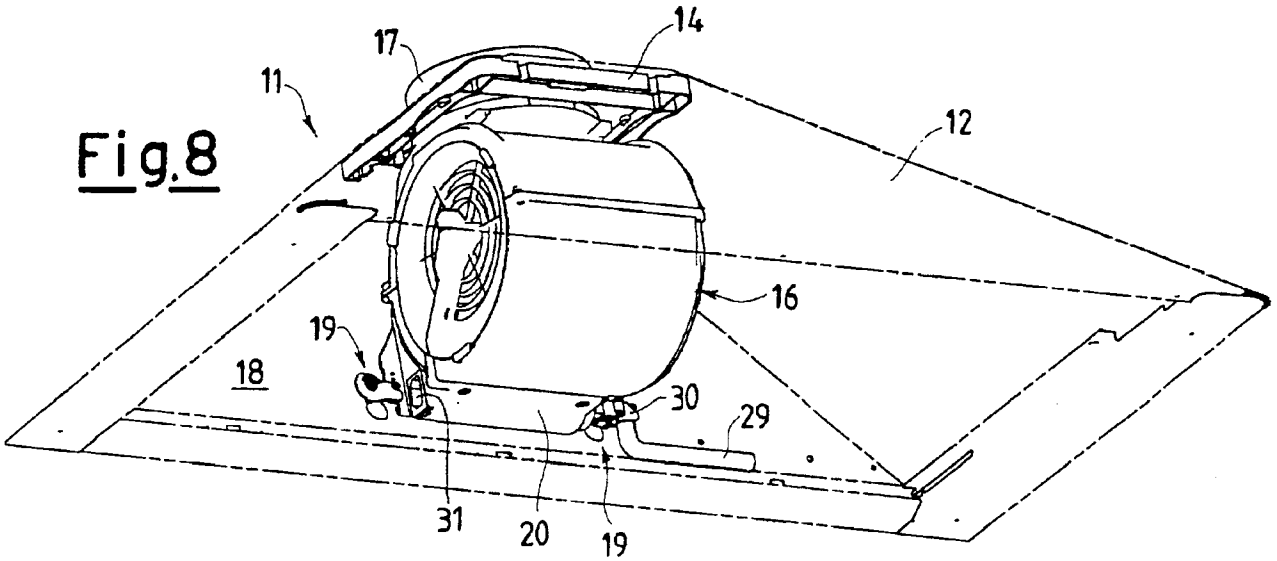
FIG. 8 shows a side perspective view of the lower part of the hood equipped with the fan blocked in position, and where the control cable has been installed in position.
Figure 7:
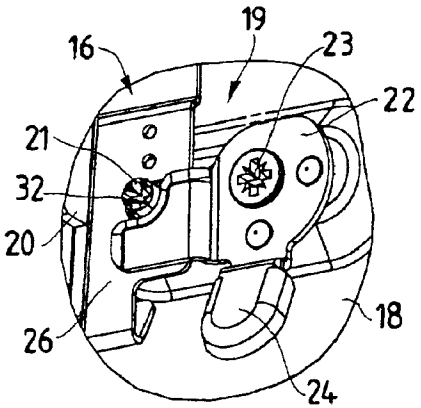
FIG. 7 is an enlarged perspective view showing the fixing element in FIG. 5 when attached to the fan.

At this point the fan 16 is firmly and closely attached to the hood structure 12, the only remaining operation being the insertion of the rapid connection 28 of the supply cable 27 and the rapid connection 30 of the control cable 29 in their respective seats (as shown at 31 in FIG. 8) foreseen on fan 16.

Such an assembling operation is extremely simple and accessible for all users.

This is also the case of the disassembly operations wherein the above mentioned steps are performed in reverse order.

In fact, disassembly comprises the disconnection of the supply cable 27 and the control cable 29, followed by the rotation of the right-angled levers 22 to release the portions of the edge plates 26 on the fan 16.

Finally, the centring pins 21 are disengaged from the slots 25 by means of a slight rotation action towards the operator, followed by sliding the upper end 15 of the fan 16 from flange 14 in a downward direction, thus obtaining the immediate removal of the fan itself.

It is easily apparent how the user can remove the components with extreme ease, and above all without the need for any specific tools. Moreover all screws that were previously located in inaccessible positions, have been eliminated.

Therefore, the hood according to the present invention achieves the aforementioned objects.

Such a hood is particularly simple in structure and does not require complicated operations for assembly and disassembly.

The domestic or industrial hood with rapid fixing device for a centrifugal fan according to the present invention can undergo numerous modifications and variations while remaining within the scope of the present invention.

Moreover, all materials employed, as well as their size and their components can be of any type according to technical requirements.

What is claimed is:

1. A hood for domestic or industrial use with a rapid fixing device for a centrifugal fan wherein an opening (13) is provided in the hood structure (12) said opening being adapted to receive one end (17) of a centrifugal fan (16), wherein said opening (13) is equipped with a centering and housing flange (14) for the upper outlet end (17) of said centrifugal fan (16) and in that at least one easily removable centering and fixing element (19) is attached to a lower portion (20) of said fan (16) on said hood structure said at least one easily removable centering and fixing element (19) includes a centering pin (21) and a right angled lever (22) rotating on said hood structure (12) around a pivot pin (23) to position itself over a lower position (20) of said centrifugal fan (16) which is equipped with a slot (25) adapted to receive said centering pin (21).

2. A hood for domestic or industrial use according to claim 1 which includes a pair of easily removable centering and fixing elements (19).

3. A hood for domestic or industrial use according to claim 1 wherein said fan (16) has seats (31) for the insertion of a rapid connection (28) of a supply cable (27) and rapid connection (30) of a control cable (29).

4. A hood for domestic or industrial use according to claim 1 wherein said slot (25) adapted to receive said pin (21) is grooved.

5. A hood for domestic or industrial use with a rapid fixing device for a centrifugal fan wherein an opening (13) is provided in the hood structure (12) and adapted to receive one end (17) of a centrifugal fan (16), wherein said opening (13) is equipped with a centering and housing flange (14) for the upper outlet end (17) of said centrifugal fan (16) and in that at least one easily removable centering and fixing element (19) is attached to a lower portion (20) of said fan (16) on said hood structure wherein said right angled lever (22) foresees an extended knob (24) for rotation purposes, and a concave portion (32) to be engaged to block said centering pin (21) over a portion of edge plate (26) of said lower portion (20) of said fan (16).

6. A hood for domestic or industrial use according to claim 5 which includes a pair of easily removable centering and fixing elements (19).

7. A hood for domestic or industrial use according to claim 5 wherein said fan (16) has seats (31) for the insertion of a rapid connection (28) of a supply cable (27) and rapid connection (30) of a control cable (29).

8. A hood for domestic or industrial use according to claim 5 wherein said slot (25) adapted to receive said pin (21) is grooved.

* * * * *